US008424934B2

(12) United States Patent
Askins

(10) Patent No.: US 8,424,934 B2
(45) Date of Patent: Apr. 23, 2013

(54) ELECTROMECHANICAL DOOR LOCKS FOR LIFTS

(76) Inventor: Tim Askins, Mt. Pleasant, SC (US)

( * ) Notice: Subject to any disclaimer, the term of this patent is extended or adjusted under 35 U.S.C. 154(b) by 487 days.

(21) Appl. No.: 12/694,545

(22) Filed: Jan. 27, 2010

(65) Prior Publication Data

US 2011/0180353 A1 Jul. 28, 2011

(51) Int. Cl.
*E05C 3/06* (2006.01)
*E05C 3/16* (2006.01)

(52) U.S. Cl.
USPC ..... 292/201; 292/199; 292/216

(58) Field of Classification Search ..... 292/199, 292/201, 216
See application file for complete search history.

(56) References Cited

U.S. PATENT DOCUMENTS

| | | | | | |
|---|---|---|---|---|---|
| 971,423 | A | * | 9/1910 | Walters | 292/201 |
| 1,036,347 | A | * | 8/1912 | Schmittberger | 292/116 |
| 1,199,199 | A | * | 9/1916 | Mason | 292/201 |
| 1,323,007 | A | * | 11/1919 | Brunete | 160/290.1 |
| 1,336,748 | A | | 4/1920 | Jenkins | |
| 1,453,551 | A | | 10/1921 | Fogal | |
| 1,459,701 | A | * | 6/1923 | Willis | 292/341.17 |
| 1,598,065 | A | | 8/1926 | Dunlop | |
| 1,709,970 | A | | 7/1927 | Brubaker | |
| 1,736,805 | A | | 11/1929 | Simmons et al. | |
| 1,901,517 | A | | 3/1933 | Jacobson | |
| 1,949,788 | A | | 3/1934 | Dunn | |
| 2,199,471 | A | | 5/1940 | Vacca | |
| 2,200,074 | A | | 5/1940 | Bouton | |
| 2,224,512 | A | * | 12/1940 | Endter | 292/214 |
| 2,280,805 | A | | 4/1942 | Dodd | |
| 2,307,542 | A | | 1/1943 | Prince | |
| 2,408,054 | A | | 9/1946 | Fenn | |
| 2,428,063 | A | | 9/1947 | Bleyle | |
| 2,520,137 | A | | 8/1950 | Erler | |
| 2,521,965 | A | | 9/1950 | Carta | |
| 2,607,618 | A | * | 8/1952 | Ernest | 292/1 |
| 2,611,840 | A | | 9/1952 | Rogers | |
| 2,788,997 | A | * | 4/1957 | Wagner et al. | 292/341.17 |
| 2,918,988 | A | | 12/1959 | Green | |
| 3,010,750 | A | * | 11/1961 | Cockburn | 292/279 |
| 3,029,900 | A | | 4/1962 | Baker | |
| 3,054,475 | A | | 9/1962 | Moser et al. | |
| 3,168,737 | A | | 2/1965 | Weinstein | |
| 3,200,905 | A | | 8/1965 | Holdridge | |
| 3,239,030 | A | | 3/1966 | Anderson et al. | |
| 3,277,979 | A | | 10/1966 | Stutz | |
| 3,292,737 | A | | 12/1966 | Crispen et al. | |
| 3,455,127 | A | | 7/1969 | Simon | |
| 3,479,851 | A | | 11/1969 | Davidson et al. | |
| 3,608,941 | A | | 9/1971 | Yokohama | |
| 3,625,312 | A | | 12/1971 | Hutner | |
| 3,733,861 | A | | 5/1973 | Lester | |
| 4,009,767 | A | | 3/1977 | Stadigh | |
| 4,268,076 | A | * | 5/1981 | Itoi | 292/216 |

(Continued)

*Primary Examiner* — Carlos Lugo
(74) *Attorney, Agent, or Firm* — B. Craig Killough; Barnwell Whaley Patterson & Helms LLC

(57) ABSTRACT

An electromechanically actuated safety lock mechanism particularly suited for elevator hall doors, dumb waiters, and similar lift mechanisms and other applications. A door lock and switch comprises a fixed contact member that is attached to a movable door and a movable locking mechanism attached to a door jamb or second moving door. The locking mechanism may include an involute gear and star wheel, a pawl constrained by a torsion spring and an electromechanical device for actuating the pawl.

30 Claims, 4 Drawing Sheets

U.S. PATENT DOCUMENTS

| | | | | | |
|---|---|---|---|---|---|
| 4,367,810 | A | | 1/1983 | Doane et al. | |
| 4,436,184 | A | | 3/1984 | Dorman et al. | |
| 4,483,420 | A | | 11/1984 | Byrne | |
| 4,974,885 | A | * | 12/1990 | Yokoyama | 292/201 |
| 4,978,153 | A | * | 12/1990 | Hirsch et al. | 292/201 |
| 5,139,112 | A | | 8/1992 | Tonna et al. | |
| 5,307,656 | A | | 5/1994 | Gartner et al. | |
| 5,487,289 | A | | 1/1996 | Otto et al. | |
| 5,507,365 | A | | 4/1996 | Prudhomme | |
| 5,508,480 | A | | 4/1996 | Quinlan | |
| 5,636,880 | A | | 6/1997 | Miller et al. | |
| 5,918,704 | A | | 7/1999 | Chevilliard et al. | |
| 6,062,345 | A | | 5/2000 | Olofsson | |
| 6,089,626 | A | * | 7/2000 | Shoemaker | 292/216 |
| 6,279,972 | B1 | * | 8/2001 | Brill et al. | 292/216 |
| 6,405,834 | B1 | | 6/2002 | Chida et al. | |
| 6,442,986 | B1 | | 9/2002 | Russell et al. | |
| 6,474,122 | B2 | | 11/2002 | Davis | |
| 6,785,603 | B2 | | 8/2004 | Inoue | |
| 6,848,286 | B2 | | 2/2005 | Dimig | |
| 7,416,228 | B2 | * | 8/2008 | Pfitzinger et al. | 292/216 |

* cited by examiner

ELECTROMECHANICAL DOOR LOCKS FOR LIFTS

FIELD OF THE INVENTION

This invention relates to interlocks generally, and is more particularly related to electromechanically operated locks that are useful in lifting devices such as elevators, lifts and dumb waiters.

BACKGROUND

Elevator landing door locks, which are commonly referred to as interlocks, are provided in elevator systems to lock hall doors against movement when the elevator car is not in position to receive loads. The interlock is a safety device that prevents access to an elevator shaft through the doors when the car is not present in the doorway. The interlock also prevents the elevator cab from moving before the door is closed and locked. Safety locks are required by numerous building safety codes.

Interlocks in common use with lifting devices are controlled by solenoids. While generally dependable, solenoids require a large coil to have sufficient power to engage and hold the locking mechanism in the 'open' position. The size of the coils that comprise these systems require that interlocks be bulky and unsightly when compared to most residential door locking mechanisms. These locks are commonly 'normally closed', such as by spring biasing, and rely on being energized to maintain an 'open' position. This design can prevent the hall door from being closed if the hall door is open and there is a power failure, since gravity moves the interlock into the 'closed' position, preventing the door from reclosing. There is a need for a device that will permit easy locking of the door if the operating device is not powered.

SUMMARY OF THE INVENTION

The present invention is a lifting device door latch and switch mechanism that permits a lifting device, such as an elevator, to move only when the car door is closed and locked, preventing access to the elevator shaft when the elevator car is not at the floor level of the door of the shaft. The device provides a positive holding mechanism that prevents inadvertent movement of the door once locked. A self-latching device locks access to hall doors in the event of loss of power to the device. The device may be used on multiple floor levels, and when any one of the doors is open, movement of the elevator is disabled.

DETAILED DESCRIPTION OF THE PREFERRED EMBODIMENTS

For purposes of illustration, the electrical components that are associated with this device are not shown in detail. The device is incorporated into known lifting devices, and is connected to a power source, signaling devices and switching devices as used with lifting devices.

Figure 2A:
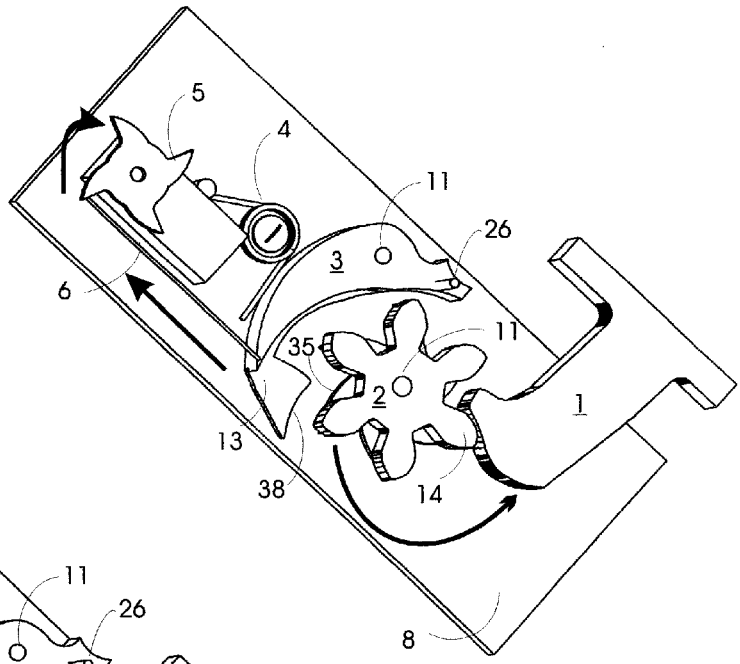
FIG. 2 is an isometric view of a latch and locking mechanism of an embodiment of the invention showing an 'open' position (FIG. 2A) and a 'closed' position (FIG. 2B).
Figure 2B:
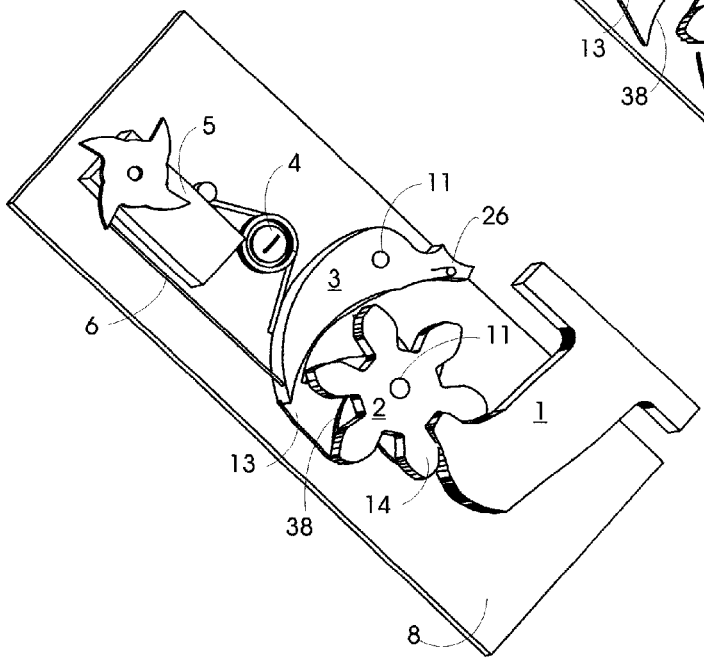
Figure 7:
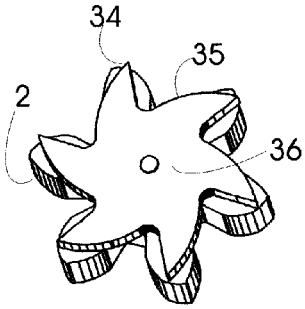
FIG. 7 is an isolation of a back side of a gear that may be used with the invention.
Figure 8:
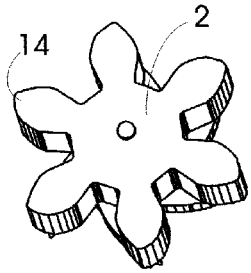
FIG. 8 is an isolation of a front side of a gear that may be used with the invention.
Figure 10:
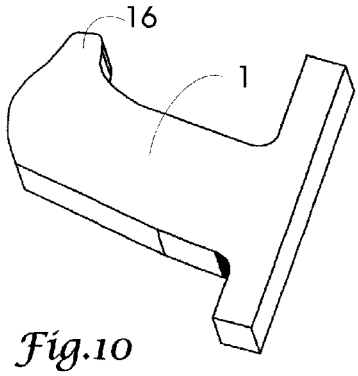
FIG. 10 is an isolation of a keeper that may be used with the invention.

Turning to the drawing figures, in a preferred embodiment, gear 2 is supported on the housing back plate 8, and is rotatable about a stationary vertical pin 11, which acts as an axle. FIGS. 2A and 2B. The gear is constrained in the 'locked' position by spring biasing, which may be provided by a torsion spring 4. The gear 2 may be constructed from a variety of materials, and in one embodiment is formed of a hard resilient material such as Acetal. The gear as shown has a central bore that receives pin 11, allowing the gear to rotate about the pin. The gear may be of a daisy shape as shown in the drawing figures, with angularly spaced teeth 14, and having intervening pockets that may be formed on the top side around the periphery of the gear 2. FIG. 8. The pockets are preferred to be formed and adapted to a size and shape that accepts the tooth 16 of the keeper 1. In this embodiment, a bottom portion 36 of the gear 2 is formed in a star or pinwheel shape having teeth 34 and pockets corresponding to the teeth of the top gear. FIG. 7 and FIG. 8. However, the lower gear may be provided as a separate part coupled to the top part of the gear 2, preferably with a square axle.

The pawl 3 is similarly preferred to be constructed with a bore offset from the center to provide a pivot point and likewise secured with a pin 11 allowing the pawl to pivot. The tail 13 of the pawl may be shaped to correspond to and match the curved face of the star wheel, so that when it rests on the convex surface 35 (FIG. 7) the angular tip of the tooth 34 (FIG. 7) engages the concave face 38 of the tail. The pawl 3 is restrained towards the gear by spring biasing such as torsion spring 4, forcing the pawl and star wheel to engage, and preventing the gear from moving in a counterclockwise direction.

Figure 3:
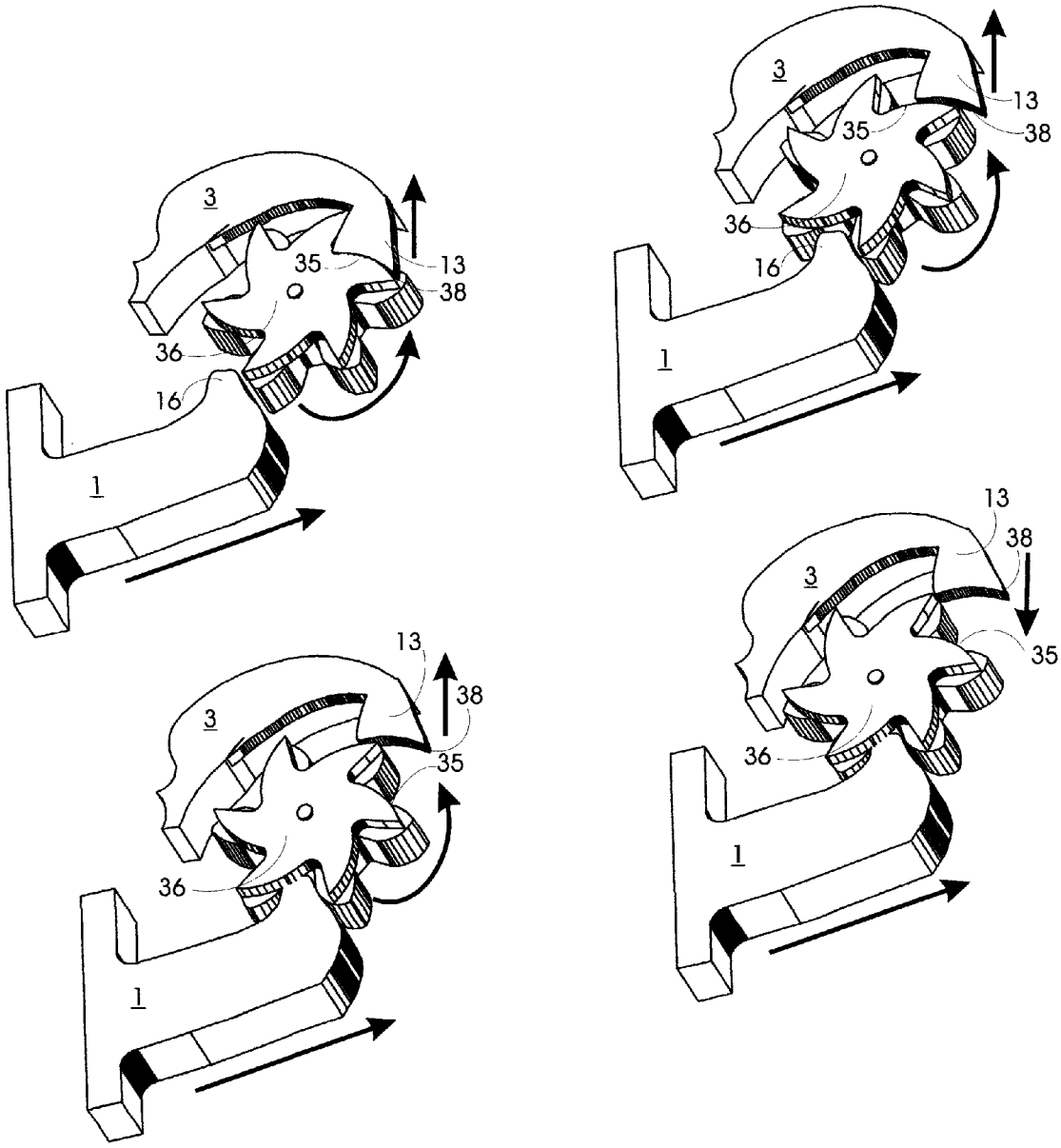
FIG. 3 is a sequence of isometric cutaway views of the back of a latch of an embodiment of the invention progressively depicting the interaction of the star-wheel, gear, pawl and the keeper in self-latching action.
Figure 4:
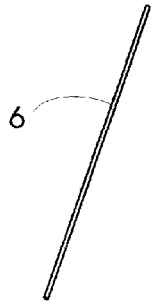
FIG. 4 is an isolation of a drive shaft that may be used with the invention.
Figure 5:
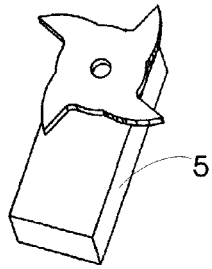
FIG. 5 is an isolation of a servo motor that may be used with the invention.
Figure 6:
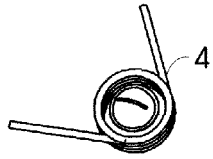
FIG. 6 is an isolation of a torsion spring that may be used with the invention.
Figure 9:
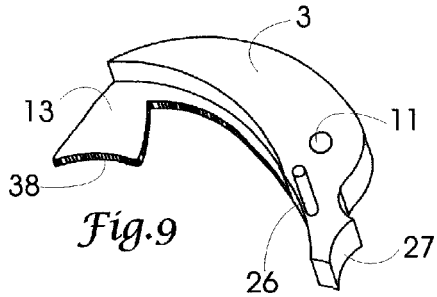
FIG. 9 is an isolation of a pawl that may be used with the invention.

An electrically actuated or electromechanical actuator, such as a servo motor 5 or a solenoid, may be positioned with a an end of the drive shaft 6 attached to the tail of the pawl 3. The opposite end of the drive shaft may be connected to a rotatable member 44 that is rotated by the servo sufficiently to resist the spring biasing of spring 4 and cause the drive shaft to lift the pawl away from the star wheel. When the device is energized it forces the pawl to move away from the star wheel, allowing the gear to turn freely, and allowing the keeper to retract from the gear pocket into the 'open' position. When the actuator is de-energized, spring 4 urges the pawl to return to the 'closed' position. Thereafter, the keeper 1 re-engages the gear while the pawl 3 is engaged with the star wheel 36. The shape of the star wheel 36 and the offset pivot of the tail of the pawl 3 are such that the pawl is forced to ride along the curved face 35 of the star wheel 36. FIG. 7. This action allows the gear 2 to turn in a clockwise direction accepting the pinion on the keeper and holding it securely in the 'closed' position. The action is illustrated in the progressive sequence shown in FIG. 3.

Figure 1:
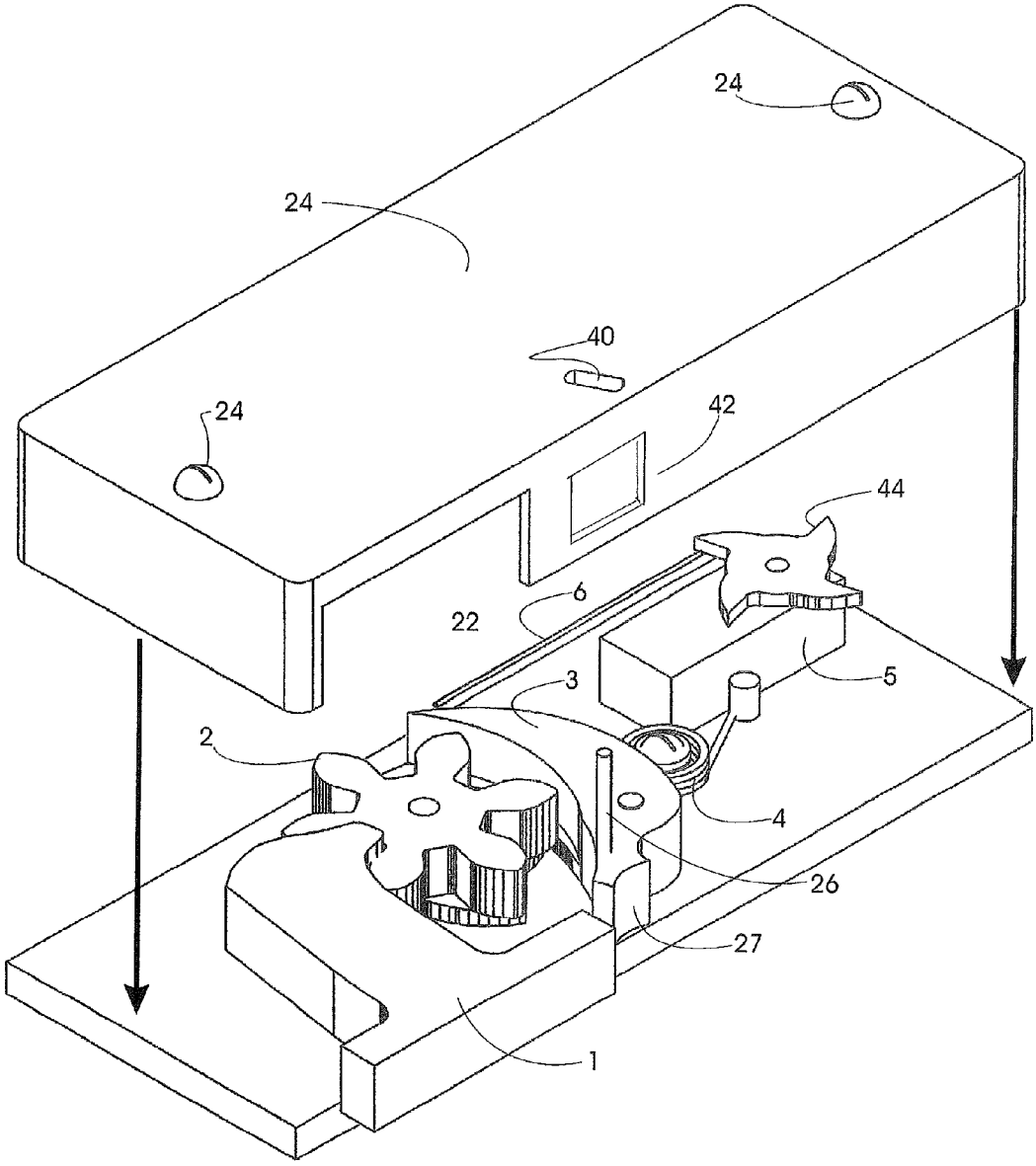
FIG. 1 is an exploded view of the latch, locking mechanism and cover of an embodiment of the invention.

The protective cover 21 (FIG. 1) may be formed to slip fit over the base 8 to form an enclosure or enclosed housing in which the spring biased and pivoting pawl and the electrically operated actuator can be contained. The protective cover may have openings 40, 42 formed to correspond with the engagement of the keeper 1 and to provide access to the manual releases, 26, 27. Manual release 26 is accessed from inside the car while handle 27 of the pawl may be accessed through an opening in the hallway door. These releases are positioned relative to the pivot point and the cover to allow manual pivoting and release of the pawl from the gear 2. As shown, the cover 21 is secured with screws 24.

The resulting interlock provides an electro-mechanical means for locking the door closed. The keeper is attached to a hall door and the backing plate 8 and associated devices are attached to the hall door jamb. Signaling devices associated with the elevator or lifting device control system control the actuator or servo. The resulting interlock holds the hallway door secure, and prevents the interruption of the safety signal. Interruption of the safety signal causes failure of the call system and prevents use and access to the car. The devices also provides means for locking the door in the event of a power interruption, but allows the door to close and lock regardless of the location of the locking mechanism at the time of the power interruption.

The embodiment of the invention as shown utilizes a ratcheting mechanism permitting motion in one direction but not the other. In this ratchet mechanism, the rotary motion about the axes are enabled for relative motion in one direction, but the pawl engages the star wheel to prevent relative motion in the other direction.

The electromechanical device of the invention may utilize either AC or DC as a power source. The device may be provided to work with any elevator system or lifting system that relies on a door latch and which can receive and transmit an electrical signal from any type of controller.

A manual override of the lock for emergency use may be provided. In the event of a power loss a battery back-up power supply may be provided to release the door lock and allow passengers to exit the elevator car. There is also an additional provision for a radio controlled remote activation of the lock for emergency release of the lock.

The invention provides a universal type lock that is not left or right handed and does not require internal reconfiguration. This feature reduces the costs of stocking specific locks for doors that open to the left or right. Further the installer or repairman is not required to reconfigure the internal components of the lock, enabling easy configuration in the field and reducing opportunities for errors in the installation/repair of locks.

The invention provides a mechanism that can be readily manufactured in a variety of means such as tamped metal, castings in metal, plastics or composites or CNC machined parts to suit the manufacturer's preferences and processes.

What is claimed is:

1. An interlock for a lifting device, comprising:

a rotating gear, a spring biased and pivoting pawl, an electrically operated actuator, wherein said electrically operated actuator is connected to said spring biased and pivoting pawl, wherein said rotating gear comprises a bottom portion comprising a plurality of teeth, and a top portion that overlays said bottom portion, said top portion of the rotating gear having the same number of teeth as the bottom portion of the rotating gear, and wherein the door keeper engages said teeth of said top portion of said rotating gear and said spring biased and pivoting pawl engages said teeth of said bottom portion of said rotating gear and prevents rotation of said rotating gear, and holds the door keeper within said teeth of said rotating gear, and upon actuation of said electrically operated actuator, said electrically operated actuator disengages said spring biased and pivoting pawl from said rotating gear, allowing said rotating gear to rotate and disengage said door keeper, and wherein the door keeper is capable of engaging said rotating gear when said spring biased and pivoting pawl is not engaged with said rotating gear, but the door keeper is not capable of disengaging from said rotating gear when said spring biased and pivoting pawl is engaged with said rotating gear, and wherein said spring biased and pivoting pawl engages said rotating gear by spring biasing.

2. An interlock for a lifting device as described in claim 1, wherein said spring biased and pivoting pawl comprises a tail that is positioned opposite an axle of the rotating gear from a pivot point of said spring biased and pivoting pawl.

3. An interlock for a lifting device as described in claim 1, wherein said rotating gear comprises a star shaped bottom portion and a daisy shaped top portion that overlays said star shaped bottom portion.

4. An interlock for a lifting device as described in claim 1, wherein said spring biased and pivoting pawl comprises a tail that is positioned opposite an axle of the rotating gear from a pivot point of said spring biased and pivoting pawl, wherein said rotating gear comprises a star shaped bottom portion and a daisy shaped top portion that overlays said star shaped bottom portion.

5. An interlock for a lifting device as described in claim 1, wherein said electrically operated actuator moves in a first direction to engage said spring biased and pivoting pawl with said rotating gear, and moves in an opposite direction to disengage the spring biased and pivoting pawl from said rotating gear.

6. An interlock for a lifting device as described in claim 1, wherein said electrically operated actuator is connected to said spring biased and pivoting pawl by a linkage, and where said electrically operated actuator moves in a first direction by spring biasing to engage said spring biased and pivoting pawl with said rotating gear, and moves in an opposite direction by electrical actuation to disengage said—spring biased and pivoting pawl from said rotating gear.

7. An interlock for a lifting device as described in claim 1, wherein said rotating gear, said spring biased and pivoting pawl and said electrically operated actuator are mounted to a base plate.

8. An interlock for a lifting device as described in claim 1, wherein said spring biased and pivoting pawl has a comprises a manual actuating pin extending outwardly therefrom and the manual actuating pin extends through an opening in a housing to an exterior of the housing.

9. An interlock for a lifting device as described in claim 2, wherein said spring biased and pivoting pawl comprises a manual actuating pin extending outwardly therefrom, and wherein said manual actuating pin is positioned opposite said pivot point from said tail.

10. An interlock for a lifting device as described in claim 2, wherein said spring biased and pivoting pawl has a comprises a manual actuating handle formed at an end thereof that is opposite said pivot point from said tail.

11. An interlock for a lifting device as described in claim 1, wherein said rotating gear, and said spring biased and pivoting pawl are contained in an enclosed housing, and wherein the enclosed housing is constructed and arranged to mount to a door jamb, and wherein the enclosed housing comprises a void in a side thereof that receives the door keeper that is mounted to a lifting device door within the enclosed housing and the door keeper is present within the enclosed housing and the door keeper engages the rotating gear within the enclosed housing.

12. An interlock for a lifting device as described in claim 1, wherein the teeth of the bottom portion of the rotating gear extend underneath the teeth of the top portion of the rotating gear and the teeth of the bottom portion of the rotating gear are at least partially covered by the teeth of the top portion of the rotating gear.

13. An interlock for a lifting device as described in claim 1, wherein the teeth of the bottom portion of the rotating gear extend underneath the teeth of the top portion of the rotating gear and the teeth of the bottom portion of the rotating gear are at least partially covered by the teeth of the top portion of the rotating gear, and the teeth of the bottom portion of the rotating gear are positioned between the teeth of the top portion of the rotating gear and a base plate.

14. An interlock for a lifting device as described in claim 1, wherein the spring biased and pivoting pawl comprises a tail that engages a tooth of the plurality of teeth of the bottom portion of the rotating gear, and wherein, when the tail of the spring biased and pivoting pawl is fully engaged with the tooth, the tail of the spring biased and pivoting pawl is bordered by the top portion of the rotating gear on a first side of the tail of the spring biased and pivoting pawl and by a base plate on an opposite side of the tail of the spring biased and pivoting pawl.

15. An interlock for a lifting device as described in claim 1, wherein said spring biased and pivoting pawl comprises a tail, wherein a first surface of each of the plurality of teeth of the bottom portion of the rotating gear comprises an arcuate and convex edge that extends substantially from a bottom of each of the plurality of teeth to substantially a top of each of the plurality of teeth, and an opposite edge of each of the plurality of teeth is a shape other than a convex shape, and the other than convex shape extends substantially from a bottom of each of the plurality of teeth to substantially a top of each of the plurality of teeth, and wherein the tail of the spring biased and pivoting pawl comprises a concave lower surface that is formed to contact substantially the entire arcuate and convex edge of one of the plurality of teeth and the tail of the spring biased and pivoting pawl comprises a side that adjoins the concave lower surface tail of the spring biased and pivoting pawl, wherein the concave lower surface of the tail contacts substantially the entire convex edge of one of the plurality of teeth while the side of the spring biased and pivoting pawl that adjoins the concave lower surface of the tail contacts substantially an entire opposite edge of an adjoining tooth.

16. An interlock for a lifting device as described in claim 1, wherein said spring biased and pivoting pawl comprises a tail, wherein a first surface of each of the plurality of teeth comprises an arcuate and convex edge that extends substantially from a bottom of each of the plurality of teeth to substantially a top of each of the plurality of teeth, and an opposite edge of each of the plurality of teeth is a shape other than a convex shape, and the other than convex shape extends substantially from a bottom of each of the plurality of teeth to substantially a top of each of the plurality of teeth, and wherein the tail of the spring biased and pivoting pawl comprises a concave lower surface that is formed to contact substantially the entire arcuate and convex edge of one of the plurality of teeth and the tail of the spring biased and pivoting pawl comprises a side that adjoins the concave lower surface tail of the spring biased and pivoting pawl, wherein the concave lower surface of the tail contacts substantially the entire convex edge of one of the plurality of teeth while the side of the spring biased and pivoting pawl that adjoins the concave lower surface of the tail contacts substantially an entire opposite edge of an adjoining tooth, and the top portion of the rotating gear rotates with the top portion of the rotating gear, and the spring biased and pivoting pawl positions the bottom portion of the rotating gear when the tail contacts substantially the entire convex edge of one of the plurality of teeth while the side of the spring biased and pivoting pawl that adjoins the concave lower surface of the tail contacts substantially an entire opposite edge of an adjoining tooth, so that the top portion of the rotating gear is positioned with an end of the door keeper fully engaged in the teeth of the top portion of the rotating gear.

17. An interlock for a lifting device as described in claim 1, wherein the electrically operated actuator is a servo motor.

18. An interlock for a lifting device, comprising:

a rotating gear, a spring biased and pivoting pawl, an electrically operated actuator, wherein said electrically operated actuator is connected to said spring biased and pivoting pawl, wherein said spring biased and pivoting pawl comprises a tail, and wherein said rotating gear comprises a top portion comprising a plurality of teeth and a bottom portion comprising a plurality of teeth, wherein a first surface of each of the plurality of teeth of the bottom portion of the rotating gear comprises an arcuate and convex edge that extends substantially from a bottom of each of the plurality of teeth to substantially a top of each of the plurality of teeth, and an opposite edge of each of the plurality of teeth is a shape other than a convex shape, and the other than convex shape extends substantially from a bottom of each of the plurality of teeth to substantially a top of each of the plurality of teeth, and wherein the tail of the spring biased and pivoting pawl comprises a concave lower surface that is formed to contact substantially the entire arcuate and convex edge of one of the plurality of teeth and the tail of the spring biased and pivoting pawl comprises a side that adjoins the concave lower surface tail of the spring biased and pivoting pawl, wherein the concave lower surface of the tail contacts substantially the entire convex edge of one of the plurality of teeth while the side of the spring biased and pivoting pawl that adjoins the concave lower surface of the tail contacts substantially an entire opposite edge of an adjoining tooth, wherein, in use, said spring biased and pivoting pawl engages said rotating gear and prevents rotation of said gear, and holds a door keeper within said teeth of said rotating gear, and upon actuation of said electrically operated actuator, said electrically operated actuator disengages said spring biased and pivoting pawl from said rotating gear, allowing said rotating gear to rotate and disengage said door keeper, and wherein the door keeper is capable of engaging said rotating gear when said spring biased and pivoting pawl is not engaged with said rotating gear, but the door keeper is not capable of disengaging from said rotating gear when said spring biased and pivoting pawl is engaged with said rotating gear, wherein said spring biased and pivoting pawl engages said rotating gear by spring biasing.

19. An interlock for a lifting device as described in claim 18, wherein said rotating gear comprises a star shaped bottom portion, and a daisy shaped top portion that overlays said bottom portion.

20. An interlock for a lifting device as described in claim 18, wherein the tail is positioned opposite an axle of the rotating gear from a pivot point of said spring biased and pivoting pawl, wherein said rotating gear comprises a star shaped bottom portion, and a daisy shaped top portion that overlays said star shaped bottom portion of the rotating gear.

21. An interlock for a lifting device as described in claim 18, wherein said electrically operated actuator moves in a first direction to engage said spring biased and pivoting pawl with said rotating gear, and moves in an opposite direction to disengage the spring biased and pivoting pawl from said rotating gear.

22. An interlock for a lifting device as described in claim 18, wherein said electrically operated actuator is connected to said spring biased and pivoting pawl by a linkage, and where said electrically operated actuator moves in a first direction by spring biasing to engage the spring biased and pivoting pawl with said rotating gear, and moves in an opposite direction by electrical actuation to disengage the spring biased and pivoting pawl from said rotating gear.

23. An interlock for a lifting device as described in claim 18, wherein said spring biased and pivoting pawl comprises a manual actuating pin extending outwardly therefrom and the manual actuating pin extends through an opening in a housing to an exterior of the housing.

24. An interlock for a lifting device as described in claim 18, wherein said spring biased and pivoting pawl comprises a manual actuating handle extending outwardly therefrom that is opposite said pivot point from said tail.

25. An interlock for a lifting device as described in claim 18, wherein said rotating gear, and said spring biased and pivoting pawl are contained in an enclosed housing, and wherein the enclosed housing is constructed and arranged to mount to a door jamb, and wherein the enclosed housing comprises a void in a side thereof that receives the door keeper that is mounted to a lifting device door within the enclosed housing and the door keeper is present within the enclosed housing and the door keeper engages the rotating gear within the enclosed housing.

26. An interlock for a lifting device as described in claim 18, wherein the teeth of the bottom portion of the rotating gear extend underneath the teeth of the top portion of the rotating gear and the teeth of the bottom portion of the rotating gear are at least partially covered by the teeth of the top portion of the rotating gear.

27. An interlock for a lifting device as described in claim 18, wherein the teeth of the bottom portion of the rotating gear extend underneath the teeth of the top portion of the rotating gear and the teeth of the bottom portion of the rotating gear are at least partially covered by the teeth of the top portion of the rotating gear, and the teeth of the bottom portion of the rotating gear are positioned between the teeth of the top portion of the rotating gear and a base plate.

28. An interlock for a lifting device as described in claim 18, wherein, when the tail of the spring biased and pivoting pawl is fully engaged with the tooth, the tail of the spring biased and pivoting pawl is bordered by the top portion of the rotating gear on a first side of the tail of the spring biased and pivoting pawl and by a base plate on an opposite side of the tail of the spring biased and pivoting pawl.

29. An interlock for a lifting device as described in claim 18, wherein the top portion of the of the rotating gear and the bottom portion of the rotating gear each have the same number of teeth, and the top portion of the rotating gear rotates with the top portion of the rotating gear, and the spring biased and pivoting pawl positions the bottom portion of the rotating gear when the tail contacts substantially the entire convex edge of one of the plurality of teeth while the side of the spring biased and pivoting pawl that adjoins the concave lower surface of the tail contacts substantially an entire opposite edge of an adjoining tooth, so that the top portion of the rotating gear is positioned with an end of the door keeper fully engaged in the teeth of the top portion of the rotating gear.

30. An interlock for a lifting device as described in claim 18, wherein the electrically operated actuator is a servo motor.

* * * * *